United States Patent [19]

Gabrielson et al.

[11] 4,356,671

[45] Nov. 2, 1982

[54] METHOD AND APPARATUS FOR CLEANING ABRASIVE SURFACES

[75] Inventors: David L. Gabrielson; Larry D. Mohr, both of Tempe, Ariz.

[73] Assignee: Belt Master, Inc., Phoenix, Ariz.

[21] Appl. No.: 168,581

[22] Filed: Jul. 14, 1980

[51] Int. Cl.[3] ..... B24B 1/00; B24B 53/02

[52] U.S. Cl. ..... 51/325; 51/262 A; 15/210 R; 134/9

[58] Field of Search ..... 51/262 A, 262 R, 135 R, 51/281 R, 325; 15/210 R, 223, 244; 125/11 R; 134/6, 9, 41

[56] References Cited

U.S. PATENT DOCUMENTS 1,429,316 9/1922 Bagi ..... 51/262 A
1,962,438 6/1934 Flanzer et al. ..... 51/262 A
2,015,603 9/1935 Maris ..... 134/42
2,665,531 1/1954 Sivertsen ..... 51/262 A

FOREIGN PATENT DOCUMENTS 1277195 6/1972 United Kingdom ..... 51/262 A

*Primary Examiner*—Roscoe V. Parker
*Attorney, Agent, or Firm*—Gregory J. Nelson

[57] ABSTRACT

A method and apparatus for cleaning abrasive belts of the type used in belt sanding operations. The apparatus includes a module having a frame composed of abradable side wall members. A block of cleaning material of natural or synthetic rubber is contained within the frame and engages the belt surface. The module is supported on a resilient base which is slightly compressible as the module passes through the belt sander to exert a uniform continuous biasing force on the belt surface to be cleaned as the module and belt are moved relative to one another.

4 Claims, 6 Drawing Figures

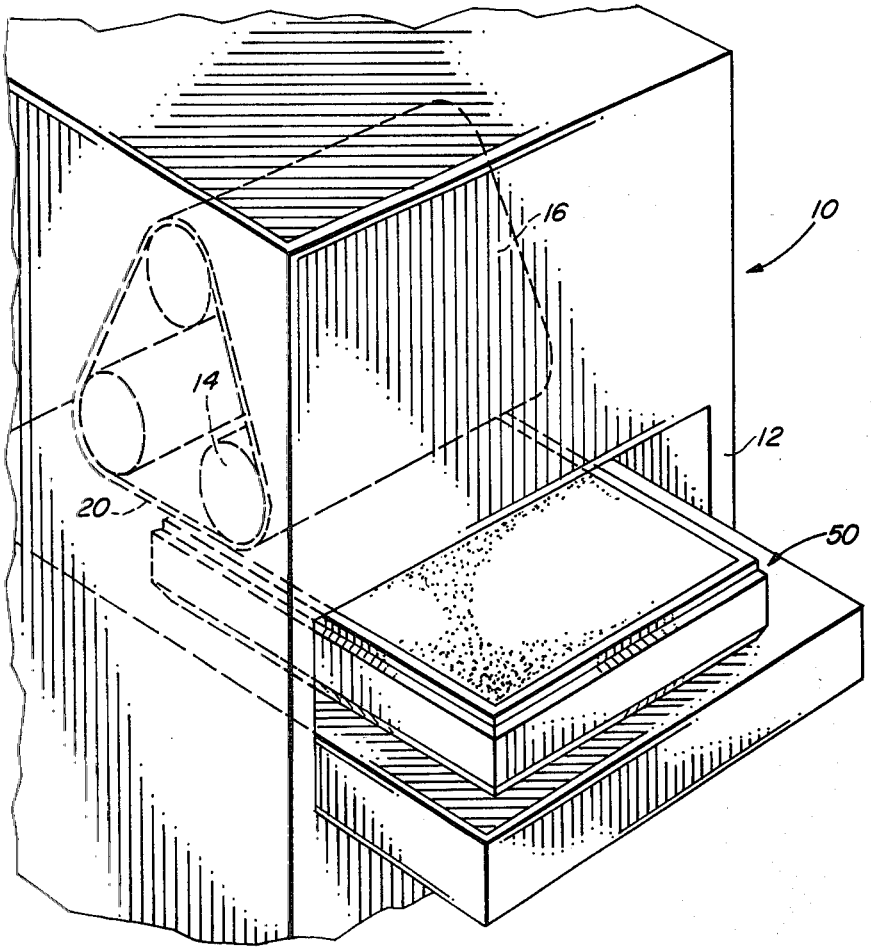
FIG. 1
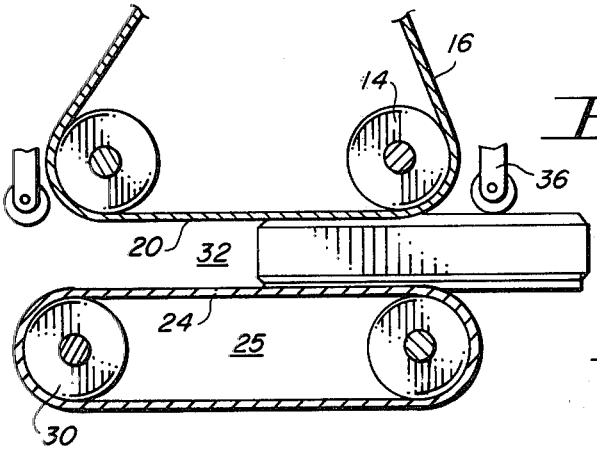
FIG. 2
FIG. 3
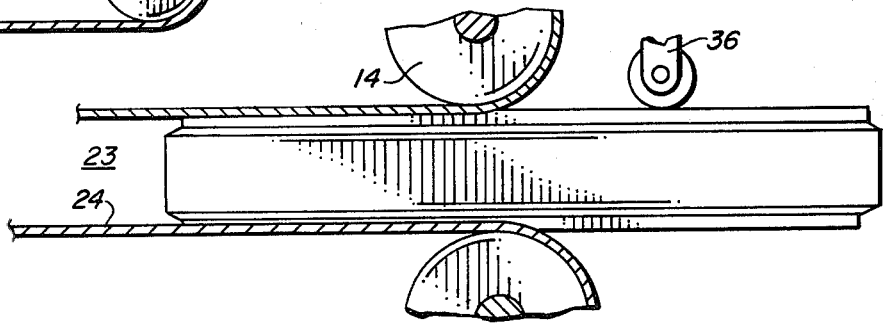

METHOD AND APPARATUS FOR CLEANING ABRASIVE SURFACES

The present invention relates to abrading and more particularly relates to a method and apparatus for cleaning dust and pitch and other materials from an abrading surface during normal operation.

Various abrading surfaces such as abrasive belts and discs used for abrading operations decrease in effectiveness as pitch, dust and other foreign materials coat and clog the abrading surface. In the woodworking and metal industry, the abrading surface will become filled in with material removed and a glazed surface will form over the abrasive preventing the abrasive surface from effectively performing.

Industry practice has been to discard clogged abrasive surfaces. The discarding of abrading surface involves waste not only in the cost of the abrasive but in the time required to replace the abrading surface.

In view of the wasteful practice of discarding clogged abrasives, the industry has been seeking methods of renewing these surfaces. U.S. Pat. No. 2,015,603 discloses a method of cleaning abrasive surfaces and reconditioning the abrading surfaces. The patent discloses a method in which glaze from abrading surfaces is removed by pressing a block of resilient gum rubber against the abrading surface and moving the block and surface relative to one another. The interaction and the frictional engagement of the rubber applied to the surface mechanically loosens the foreign substance that clogs the interstices of the abrasive surface.

Other industry accepted methods for dealing with clogged abrasives are available. Solvents have been used to clean abrasives but have the disadvantage of restrictive cost and also result in reducing the life of the belt. Steam cleaning, also used, results in diminishing the life of the abrasive belt due to the action of water on the coated abrasive.

Accordingly, there exists a need for an effective method and apparatus for conveniently cleaning abrasive surfaces during normal operation.

The present invention relates to an impoved apparatus and method for cleaning abrading surfaces, particularly the type which utilizes large continuous belts having an abrasive surface. The present invention represents an improvement over the aforementioned patent. Briefly, the present Invention provides a cleaning material of natural or synthetic rubber within a frame module. The rubber is within a frame which rests on a rigid bottom and resilient or compressible runner strips are provided on the underside of the module. The particular shape and dimensions of the module may vary and are selected so the module has a width approximately corresponding to the width of the continuous abrasive belt to be cleaned. The method involves moving the module relative to the abrading surface. As the surface of the cleaning material module engages the abrading surface, the material causes the clogging materials in the intersticial areas to be mechanically removed. The module frame is abraded away in the cleaning process. The resilient runner strips on the underside of the module maintain a compression force holding the abrading surface and cleaning material in engagement when the module is passed through a belt abrading device.

The above and other objects and advantages of the present invention will be more fully appreciated and understood from the following description, claims and drawings in which:

FIG. 1 is a partial perspective view of a belt sander illustrating the cleaning module of the present invention positioned between the conveyor belt and sanding head;

FIG. 2 is a side view of a portion of the belt sander showing the cleaning module of the present invention positioned therein;

FIG. 3 is an enlarged side view of a portion of a belt sander illustrating the cleaning module of the present invention positioned between the conveyor and abrading surface;

Figure 4:
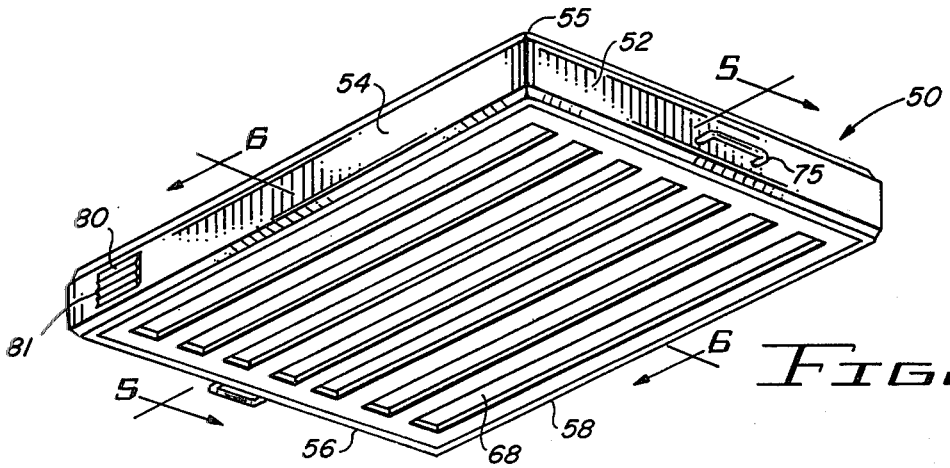
FIG. 4 is a bottom perspective view of the cleaning module of the present invention.

Various abrading devices are used in the woodworking and metal industry. Belt sanders are commonly used as shown in FIGS. 1 to 3. The sander of this type is generally designated by the numeral 10 and includes frame 12 which supports a plurality of transversely extending drums or heads 14 around which extends a continuous abrasive belt 16. The sanding or abrasive action and material removal takes place along the belt area indicated by the numeral 20. A bed, generally indicated by the numeral 25 is located below belt portion 20 and includes a conveyor belt 24 disposed generally horizontally with respect to belt section 20. Conveyor belt 24 is continuous and is in driven engagement with drum 30. Workpieces are moved through the work area 32 by the conveyor belt 24. For optimum performance, the sanding heads and the conveyor belt should be in accurate alignment. One or more hold-down shoes or pressure rollers 36 may be disposed adjacent the entrance and exit of the work area 32 to prevent "dubbing" of the workpiece as the workpiece passes through the work area. The belt sanding arrangement shown in FIGS. 1 to 3 provides adjustability to increase or decrease the pressure on the workpiece as the work passes through the work area 32. The apparatus and method of the present invention is equally adaptable for use with single belt sanders and the adjustable arrangement is shown only for the purposes of illustration.

Figure 5:
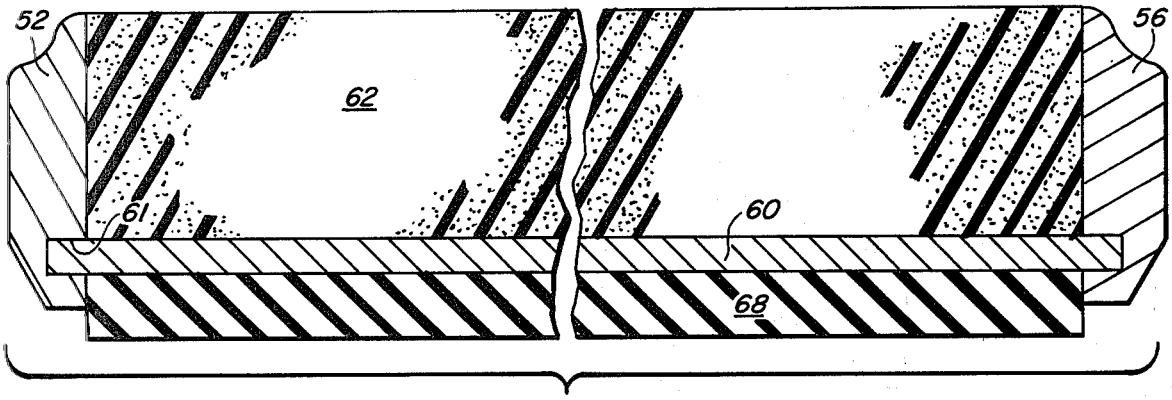
FIG. 5 is a sectional view taken along lines 5—5 of FIG. 4.
Figure 6:
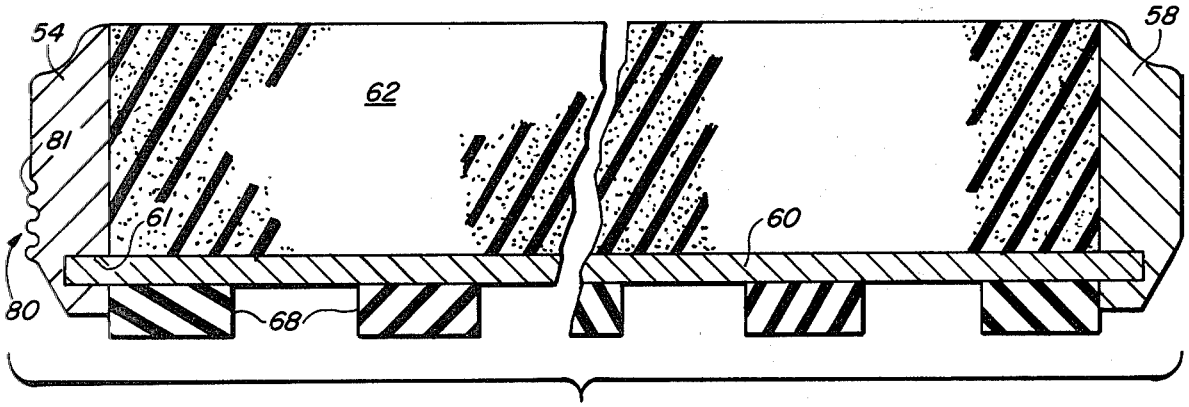
FIG. 6 is a sectional view taken along lines 6—6 of FIG. 4.

The cleaning module of the present invention is best illustrated in FIGS. 4 to 6 and is generally designated by the numeral 50. Module 50 includes an outer frame which is shown as rectangular and having opposite end walls 52 and 56 and opposite sidewalls 54 and 58. The sidewalls may be constructed from any suitable material which abradable such as wood or plastic. In the event the frame members are constructed of wood, the corner joint 55 may be appropriately mitered and joined by a bonding agent or adhesive. If the frame is constructed of a plastic material, the entire frame can be molded from a single piece of plastic such as ABS or PVC. A grip 75 may be secured to end walls 52 and 56 for convenience of handling.

The inner walls of the frame members 52, 54, 56 and 58 are provided with a groove 61 near the lower edges of the frame members. Groove 61 receives a substantially rigid bottom or floor panel 60 which may be plastic, wood or a composition material such as that sold under the trademark Masonite. The module interior defined by the side walls and bottom panel contain the block of cleaning material 62. The cleaning material, as is known in the prior art, is preferably in the form of a gum or plantation crepe natural rubber or may be a synthetic rubber. The cleaning material 62 is somewhat flexible and when applied against the abrasive surface mechanically loosens and removes the foreign substances that clog the intersticial areas of the abrasive surface.

The entire module is supported on a base which consists of a plurality of compressible runner strips 68 extending longitudinally between ends 52 and 56 and transversely spaced-apart as best seen in FIG. 6. The runner strips may be of an appropriate material such as sponge rubber or neoprene foam compressing slightly under the application of compressive force to provide a biasing force to maintain the module and belt in engagement. The complete module should be free of any metal components.

A wear indicator 80 is provided on side wall 54. Wear indicator 80 comprises a plurality of individual indicia 81, 82 and 83 which indicate to the user the extent of wear that has taken place on the module. For example, indicia can be graduated in inches as measured from the top of base panel 60 indicating the thickness of cleaning material 62 remaining and usable.

The method of the present invention is best indicated in FIGS. 1 to 3. The module 50, constructed as has been described above, is placed on the conveyor 24 of sander 12. The module should be selected having a width dimension approximately corresponding to the width of the sander belt. Accordingly, modules ma be provided in several standard sizes. Preferably, the relationship of the conveyor and sanding heads is adjusted so that a slight compressive force on the module is exerted as best indicated in FIG. 3. The resilient, compressive runner strips 68 will compress under the application of force so that a continuous upward pressure is exerted against the belt section 20. Conveyor belt 24 causes the module to move leftwardly through the work area as best seen in FIG. 3 engaging the belt section 20 in the work area 32. The cleaning material 62 creates a gripping action against the surface of the abrasive and the resulting action action loosens foreign substances that clog the belt. As the module 50 passes through the work area 32, a portion of the cleaning material 62 and a portion of the peripheral frame is worn or abraded away. The peripheral frame of the module prevents the cleaning material from deforming under compression so the cleaning material remains in uniform and continuous contact with the belt surface to be cleaned. The module may be reused until the cleaning material 62 is substantially exhausted as indicated by the wear guage indicia 80 at the side of the module. When the cleaning material 62 is fully consumed, the module may be discarded and a new module used.

The resilient base runner strips 68 assist in aligning the module properly with the belt surface 20 and maintaining proper contact so a wide belt sander can be cleaned by an operator in a manner similar to running a piece of stock through the sander. One to three passes is usually sufficient to clean a single belt. The rigid or substantially rigid panel 60 which support the cleaning material gives rigidity to the module and helps to maintain the material in engagement with the belt.

The belt cleaning apparatus and method of the present invention effectively cleans off abrasive belts while minimizing need for machine shut-down and the disadvantages attendant to conventional cleaning techniques. Use of modules constructed according to the present invention on belt sanders of the type shown in FIGS. 1 to 3 in the woodworking and metal industry has demonstrated that if the module is run through the sander two or three times every hour during machine operation, abrasive belt life is more than doubled as compared to cleaning using conventional liquid solvents. Further, the apparatus and method of the present invention can save substantial labor and down-time up to thirty percent. Based on 1.36" by 72" wide belt, which normally uses one belt per day with liquid cleaning, comparisons indicate that at least several hundred dollars per month per machine can be saved using the present invention when product cleaning and labor costs are taken into consideration.

Thus, it will be seen from the foregoing that the present invention provides a unique method and apparatus for cleaning abrasive belts. It will be obvious to those skilled in the art to make various changes, alterations and modifications to the invention described herein. To the extent that these changes, alterations and modifications do not depart from the spirit and scope of the appended claims, they are intended to be encompassed therein.

I claim:

1. A method of cleaning clogging materials from the abrasive surface of a continuous abrasive belt machine having an adjacent spaced-apart conveyor with a work area defined between said belt and conveyor, said method comprising:

(a) passing a cleaning module independent of said machine across the said work area so an area of the belt and module are moved relative one to the other, said module having a width substantially corresponding to the belt width and having a cleaning material contained within an abradable frame;

(b) biasing said belt and module in contact one with the other as the module moves across the work area to cause said cleaning material to engage said belt and remove dust and pitch build-up.

2. An apparatus for cleaning clogging materials from a moving abrasive belt surface of a sanding machine, said apparatus comprising:

(a) a frame independent of said machine having side walls and a bottom and being comprised of an abradable material;

(b) a cleaning material contained within said frame for causing removal of foreign material when engaged against the abrasive surface width;

(c) resilient biasing means on the said bottom of said frame adapted to urge said cleaning material and said abrasive belt in substantial contact as the said frame and belt are moved relative one to the other.

3. The apparatus of claim 2 wherein said cleaning material comprises a block of natural plantation crepe rubber.

4. The apparatus of claim 2 wherein cleaning material is supported on a substantially rigid bottom extending within said frame and said resilient biasing means is secured to the underside of said bottom.

* * * * *